US008821137B2

(12) United States Patent
Tetzlaff et al.

(10) Patent No.: US 8,821,137 B2
(45) Date of Patent: Sep. 2, 2014

(54) MODULAR DOWN HOLE GAUGE FOR USE IN RETRIEVABLE ELECTRIC SUBMERSIBLE PUMP SYSTEMS WITH WET CONNECT

(75) Inventors: Steven K. Tetzlaff, Owasso, OK (US); Ken Bebak, Tulsa, OK (US); Robert H. McCoy, Talala, OK (US); Lance T. Robinson, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 370 days.

(21) Appl. No.: 13/166,511

(22) Filed: Jun. 22, 2011

(65) Prior Publication Data

US 2011/0311375 A1 Dec. 22, 2011

Related U.S. Application Data

(60) Provisional application No. 61/357,305, filed on Jun. 22, 2010.

(51) Int. Cl.

| | |
|---|---|
| ***F04B 17/00*** | (2006.01) |
| ***F04B 35/04*** | (2006.01) |
| ***F04B 49/00*** | (2006.01) |
| ***E21B 29/02*** | (2006.01) |
| ***E21B 43/02*** | (2006.01) |
| ***F04B 17/03*** | (2006.01) |
| ***F04B 47/06*** | (2006.01) |

(52) U.S. Cl.

CPC ..... *F04B 47/06* (2013.01); *F04B 17/03* (2013.01)

USPC ..... 417/423.3; 417/63; 166/65.1; 166/66

(58) Field of Classification Search

USPC ..... 417/63, 423.3, 423.4, 44, 44.2, 44.1; 439/190–205; 166/65.1, 66

See application file for complete search history.

(56) References Cited

U.S. PATENT DOCUMENTS

| | | | | |
|---|---|---|---|---|
| 5,803,167 | A | 9/1998 | Bussear | |
| 6,396,415 | B1 * | 5/2002 | Bulmer | 340/855.8 |
| 6,464,004 | B1 | 10/2002 | Crawford | |
| 7,624,800 | B2 | 12/2009 | Jamieson | |
| 8,291,983 | B2 * | 10/2012 | Rooks | 166/369 |
| 2005/0109515 | A1 * | 5/2005 | Watson et al. | 166/369 |
| 2009/0277628 | A1 * | 11/2009 | Watson et al. | 166/250.01 |
| 2010/0122818 | A1 * | 5/2010 | Rooks | 166/369 |

FOREIGN PATENT DOCUMENTS

| | | |
|---|---|---|
| GB | 2309471 | 7/1997 |

* cited by examiner

*Primary Examiner* — Devon Kramer

*Assistant Examiner* — Lilya Pekarskaya

(74) *Attorney, Agent, or Firm* — Law Offices of Mark L. Berrier

(57) ABSTRACT

Systems and methods for employing gauge packages for use with a wet-connect ESPs. In one embodiment, a modular gauge package includes a body, a gauge electronics assembly housed within the body, and a pair of electrical connectors at the upper and lower ends of the body, where power is passed through the body from one connector to the other. The electrical connector at the top of the body engages a complementary electrical connector on the bottom of a pump motor. The electrical connector at the bottom of the body engages a complementary electrical connector at the end of a production conduit. The connector at the bottom of the body may be identically configured with the connector at the bottom of the pump motor, and the connector at the top of the body may be identically configured with the connector at the end of the production conduit.

8 Claims, 3 Drawing Sheets

MODULAR DOWN HOLE GAUGE FOR USE IN RETRIEVABLE ELECTRIC SUBMERSIBLE PUMP SYSTEMS WITH WET CONNECT

CROSS-REFERENCE TO RELATED APPLICATIONS

This application claims the benefit of U.S. Provisional Patent Application 61/357,305, filed Jun. 22, 2010, which is incorporated by reference as if set forth herein in its entirety.

BACKGROUND

1. Field of the Invention

The invention relates generally to downhole equipment for use in wells, and more particularly to modular gauges that are configured to be used with electric submersible pump ("ESP") systems that employ "wet connections" to supply power to the pump motors.

2. Related Art

A pump may be required to produce fluid from a well. Electric submersible pumps "ESP's" are typically used for this purpose. Conventionally, an ESP is connected to the end of tubing that is then lowered into the well. The tubing is positioned so that the ESP is located in the well bore where fluid from the surrounding geological formation is allowed to flow into the well. Gauges can be attached at the bottom of the ESP system to allow various parameters (e.g., motor temperature, fluid temperature, fluid pressure, etc.) to be monitored and communicated to the surface, either through dedicated communication lines, or via "comms-on" transmissions over the power cable.

Conventionally, power is provided to the ESP through a cable that transmits power (typically three-phase power) from a motor controller at the surface of the well to the ESP system. The power cable is attached to a connector at the top of the ESP's motor and runs from the motor, along the outside of the tubing, to the motor controller. If gauges are used, electrical connections are made between the gauge and motor before the gauge unit is attached to the bottom of the motor. This enables communications between the gauges and surface equipment through the motor via the power cable.

If there are problems with the pump, motor or gauges, they must be removed from the well so that they can be repaired or replaced. In a conventional installation, because the ESP is secured to the bottom of the tubing string, the tubing and cable must be pulled out of the well in order to reach the pump, motor and/or gauges. Removing the tubing normally requires the use of a work over or drilling rig, which is expensive and impacts well production based on rig availability and work over time.

The expense of removing the tubing, cable and attached equipment from wells using conventional rigs has led to the development of retrievable ESP systems that employ "wet connections" to couple the pump and motor to the power source on the surface. In these systems, a portion of the electrical connection is secured near the lower end of tubing/production conduit which has a large enough diameter to install the ESP system inside it. The power cable is attached to the outside of the tubing as in a conventional system, but the power cable ends at a connector near the end of the tubing. After the tubing (with the power cable) is installed in the well, the pump and motor can be connected to wireline, wire rope, coiled tubing or jointed pipe which then allows the ESP system to be conveyed/lowered into the well inside the larger-diameter tubing/production conduit. When the pump and motor reach the bottom of the production conduit, a series of conductors at the bottom of the pump motor engages the conductors in the electrical connection near the bottom of the production conduit. This completes the connection between the power cable and the ESP pump motor so that the pump can be operated to produce fluid from the well.

SUMMARY OF THE INVENTION

As noted above, when gauges are used with ESP's, they are normally attached to the bottom of the pump motor and receive their power from the pump motor. Because, in a wet connection system, it is necessary to provide a connector on the bottom of the pump motor to engage the connector at the end of the production conduit/tubing, the gauge cannot be conventionally attached to the bottom of the pump motor. Rather than redesigning the pump motor to incorporate the gauge sensors and electronics, the present system utilizes connectors that are complementary to the motor and plug connectors, thereby providing a modular system that allows gauges to be added to existing pump motors that are configured for wet connections.

One embodiment comprises a modular gauge package for use with a wet-connect ESP. The modular gauge package includes a body, a gauge electronics assembly housed within the body, and a pair of electrical connectors at the upper and lower ends of the body, where power is passed through the body from one connector to the other. The electrical connector on the upper end of the body is configured to engage a complementary electrical connector at the lower end of a pump motor. The electrical connector at the lower end of the body is configured to engage a complementary electrical connector at the lower end of a production conduit. The pair of electrical connectors at the ends of the body is connected by a set of conductors that may be enclosed within the body, but bypass the gauge electronics assembly within the body. In one embodiment, the connector at the lower end of the body is identically configured with the connector at the lower end of the pump motor, and the connector at the upper end of the body is identically configured with the connector at the lower end of the production conduit. In this embodiment, the connectors at the lower end of the pump motor and the lower end of the production conduit are configured to mate, in the absence of the modular gauge package, with each other. The modular gauge package may include a conductor configured to be connected to a motor to draw power from the motor.

Another embodiment comprises a wet-connect ESP system for use in downhole applications. The system includes a pump, a motor configured to drive the pump, and a gauge package coupled to the motor. The ESP system is configured to fit within a production conduit. The gauge package is positioned at the lower end of the ESP system and has an electrical connector which is configured to engage an electrical connector which is affixed to the lower end of the production conduit. The electrical connector at the bottom of the gauge package is configured to engage the electrical connector of the production conduit. The gauge package is configured to convey power provided via the production conduit's electrical connector through the gauge package to the motor. The gauge package may be modular, with a connector at the lower end of the gauge package being identically configured with a connector at the lower end of the pump motor, and a connector at the upper end of the gauge package being identically configured with the connector at the lower end of the production conduit. In this embodiment, the connectors at the lower end of the pump motor and the lower end of the production conduit are configured to mate with each other in the absence of the modular gauge package. The gauge package may be configured to pass three-phase power through three separate conductors from the electrical connector at the bottom of the gauge package to the electrical connector at the upper end of the gauge package. An electronics assembly of the gauge package may be configured to receive power from the motor, for example, through a conductor coupled within the motor stator winding.

Yet another embodiment comprises a method for providing power to an ESP system. The method begins with providing power to a first electrical connector at a lower end of a conduit within a well bore. A gauge package is connected to a lower end of the ESP system, where the gauge package has a set of conductors that extend through it. Each of the conductors has an upper end which is electrically connected to a motor section of the ESP system and a lower end which is coupled to an electrical connector at the lower end of the gauge package. The ESP system and gauge package are lowered into the conduit to engage the electrical connector on the gauge package with the electrical connector at the end of the conduit. This electrically couples the power from the conduit's electrical connector to the motor section of the ESP system through the conductors which extend through the gauge package.

Numerous other embodiments are also possible.

BRIEF DESCRIPTION OF THE DRAWINGS

Other objects and advantages of the invention may become apparent upon reading the following detailed description and upon reference to the accompanying drawings.

Figure 1:
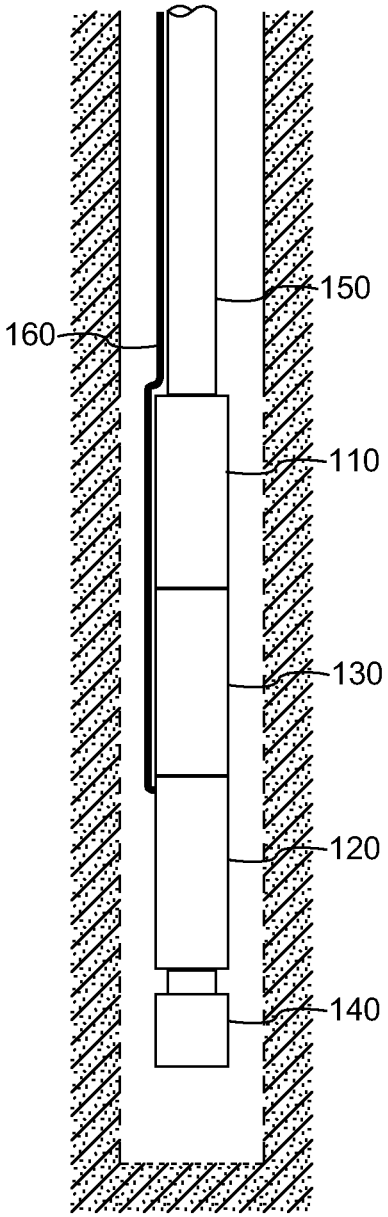
(Prior art) Fig. 1
FIG. 1 is a diagram illustrating a conventionally configured ESP positioned in a well bore.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DETAILED DESCRIPTION OF PREFERRED EMBODIMENTS

One or more embodiments of the invention are described below. It should be noted that these and any other embodiments described below are exemplary and are intended to be illustrative of the invention rather than limiting.

Referring to FIG. 1, a diagram illustrating a conventionally configured ESP positioned in a well bore is shown. In this figure, the ESP consists of a pump section 110, a motor 120, and a seal 130 that couples the motor to the pump. Each of these components is bolted together. Additionally, this pump system includes a gauge package 140 which is bolted or otherwise attached to the lower end of motor 120. Pump 110 is connected to the lower end of tubing 150. Power cable 160 is connected to the outside of tubing 150 and extends along the outside of pump 110 and seal 130 to the top of motor 120. Power cable 160 connects motor 120 to a power source at the surface of the well. Gauge package 140, in addition to being attached to motor 120, is electrically connected to the motor. Power from cable 160 is thereby supplied to motor 120, which in turn provides power to gauge package 140. This electrical connection also allows gauge package 140 to communicate with surface equipment via motor 120 and power cable 160.

Figure 2:
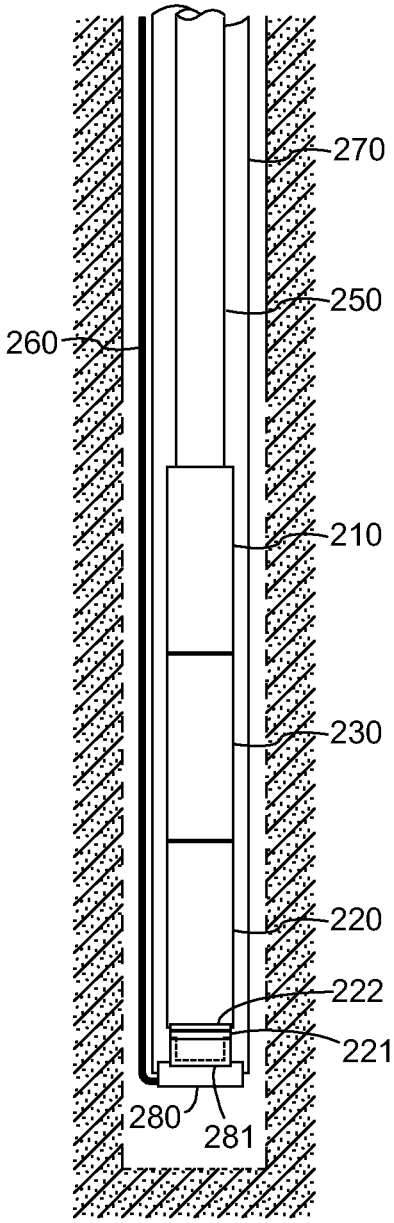
(Prior art) Fig. 2
FIG. 2 is a diagram illustrating a conventional ESP system that employs a "wet connection".

Referring to FIG. 2, a diagram illustrating a conventional ESP system that employs a "wet connection" is shown. In this figure, the ESP system consists of a pump 210, a motor 220 and a seal 230. Each of these components is bolted together, connecting motor 220 to pump 210 through seal 230. Pump 210 is attached to conveyance medium 250. Conveyance medium 250 can consist of wireline, wire rope, coiled tubing, jointed rods, jointed tubing, or the like. With the ESP system secured to the lower end, conveyance medium 250 is positioned within previously installed, production tubing/conduit 270. A plug 280 is secured at the lower end of tubing 270. Power cable 260 is connected to the outside of tubing 270 and extends to plug 280. Power cable 260 is coupled to an electrical connector 281 within plug 280. The lower end of motor 220 is coupled by a modular connection 222 to a wet-connect electrical connector 221 which is complementary to connector 281. Thus, when the ESP system reaches the bottom of tubing 270, electrical connectors 221 and 281 mate, providing power from cable 260 to motor 220.

It should be noted that no gauge package is included in the ESP system illustrated in FIG. 2. Gauge packages are conventionally configured to be attached (e.g., bolted) to the lower end of the pump motor and to receive electrical power from the motor. Because such a gauge package would interfere with the wet connection between pump motor connector 221 and plug connector 281, existing wet connect systems do not use these gauge packages.

Figure 3A:
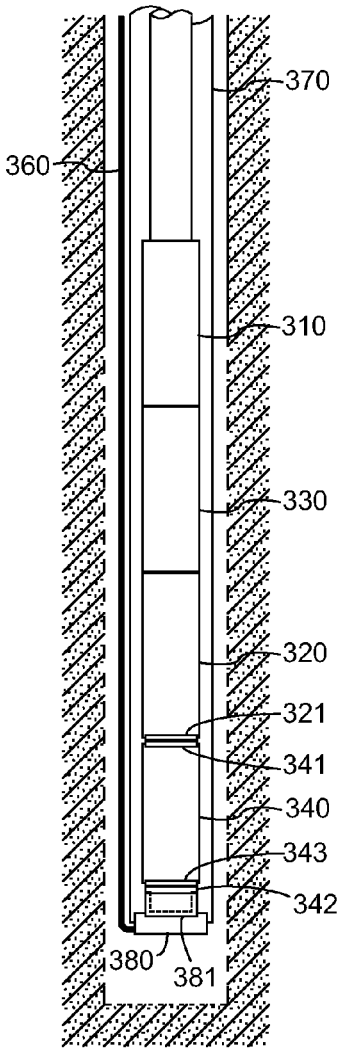
FIG. 3A is a diagram illustrating an ESP system in accordance with one embodiment.

Referring to FIG. 3A, a diagram illustrating an ESP system in accordance with one embodiment of the invention is shown. This system includes a gauge package that is modularly configured for use in a "wet connection" or "wet-connect" system. The ESP system of FIG. 3A includes a pump 310, a motor 320, a seal 330 and a modular gauge 340. The pump, motor and seal components are assembled in a conventional manner. Motor 320 has a modular electrical connection 321 that is configured to be coupled to a wet-connect electrical connector 342 (which is configured to mate with complementary electrical connector 381 of plug 380). In this system, however, modular gauge 340 is connected to the lower end of motor 320. Modular gauge 340 includes electrical connectors 341 and 343 which are functionally identical to connectors 342 and 321. Electrical connectors 341 and 343 are electrically coupled to pass power, as well as communication signals, through the modular gauge package between motor 320 and plug 380.

Figure 3B:
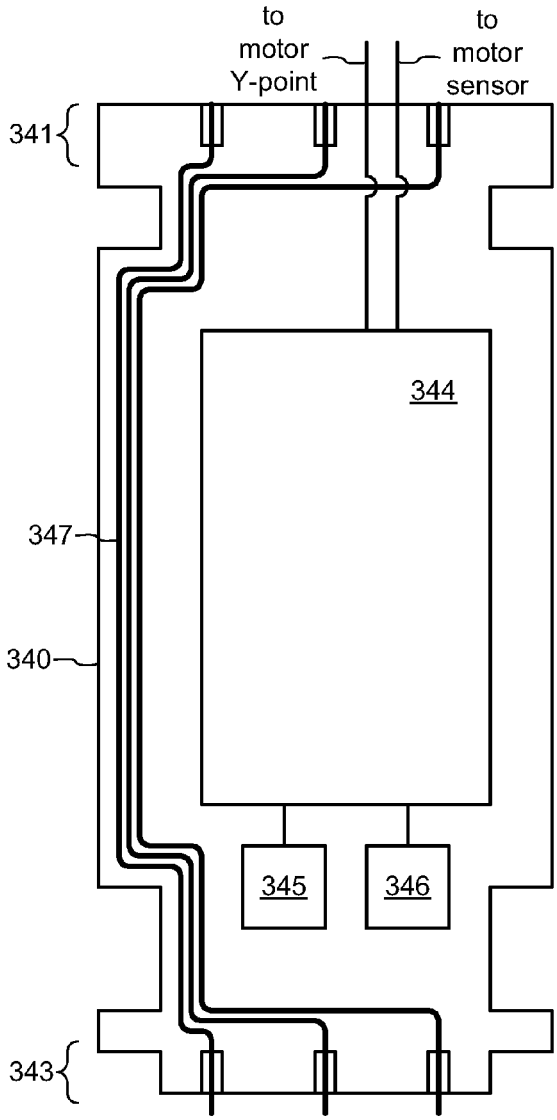
FIG. 3B is a diagram illustrating in more detail the modular gauge package of the embodiment of FIG. 3A.

Referring to FIG. 3B, a diagram illustrating in more detail the modular gauge package of FIG. 3A is shown. In this figure, it can be seen that each of connectors 341 and 343 includes three terminals. Each of the terminals of connector 341 is connected to one of the terminals of connector 343 by a corresponding conductor (e.g., 347). The conductors are routed along the outer wall of the body of gauge package 340, around the electronics assembly of the gauge package. In this embodiment, the electronics assembly includes circuitry 344, and sensors 345 and 346. Circuitry 344 may also be coupled to sensors in the motor (not shown in the figure). The electronics assembly is also coupled to the Y-point of the motor to draw power from the motor. The same conductor that couples the gauge package to the Y-point may be used for communications in a comms-on system.

Figure 4:
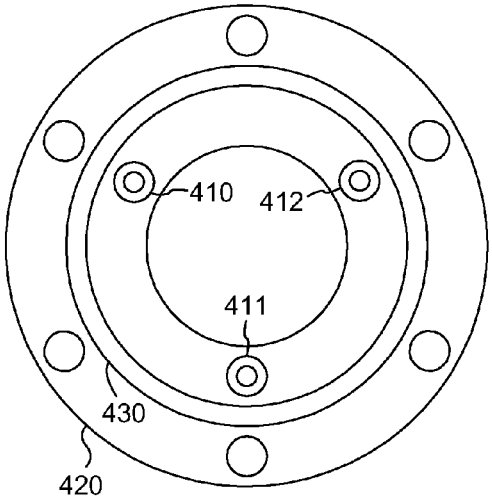
FIG. 4 is a diagram illustrating a view of the bottom end of a modular gauge package in accordance with one embodiment.
Figure 6:
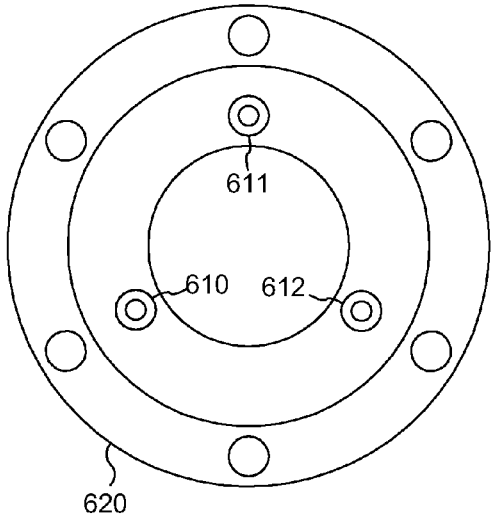
FIG. 6 is a diagram illustrating a view of the top end of a modular gauge package in accordance with one embodiment.
Figure 5:
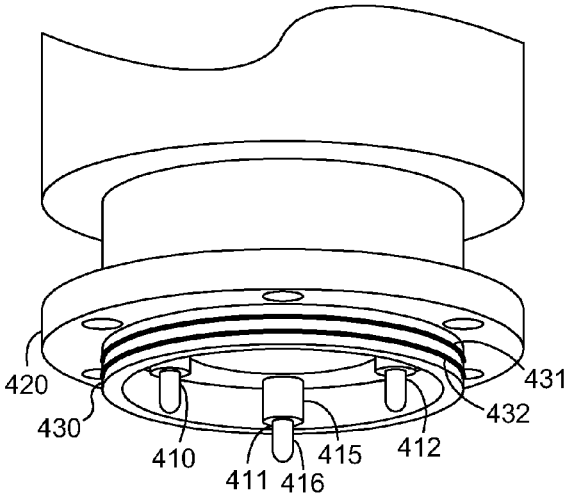
FIG. 5 is a diagram illustrating a perspective view of the lower end of a modular gauge package in accordance with one embodiment.
Figure 7:
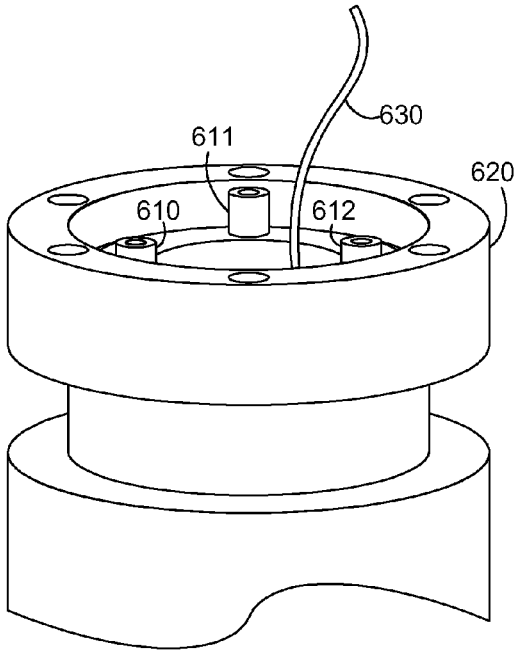
FIG. 7 is a diagram illustrating a perspective view of the upper end of a modular gauge package in accordance with one embodiment.

Referring to FIGS. 4-7, diagrams illustrating the upper and lower ends of the modular gauge package are shown. FIGS. 4 and 6 are bottom and top views, respectively, while FIGS. 5 and 7 are perspective views of the bottom and top, respectively, of the modular gauge. As noted above, the configuration of the connection on the bottom of the modular gauge is functionally identical to the connection on the bottom of the motor, while the configuration of the connection on the top of the modular gauge is functionally identical to the connection on the plug at the end of the larger-diameter tubing.

Referring to FIGS. 4 and 5, the lower end of the modular gauge includes three male conductors 410-412. Each of the male conductors includes a cylindrical insulating shield (e.g., 415) and a central electrical conductor (e.g., 416) that extends beyond the insulating shield. Referring to FIGS. 6 and 7, the upper end of the modular gauge includes three female conductors 610-612. Each of the female conductors includes a central electrical conductor surrounded by a cylindrical insulating shield. Female conductors 610-612 are recessed within flange 620. This protects the conductors and aids in the positioning of the connectors with respect to the pump motor. Each of the male conductors is electrically connected to a corresponding one of the female conductors. Consequently, when an electrical signal is applied to one of the male conductors, it is applied to the corresponding female conductor, and vice versa. Thus, power and communication signals that are applied to the connectors at the bottom of the modular gauge are passed through the gauge to the pump motor. Likewise, communication signals that are applied to the connectors at the top of the modular gauge are passed through the gauge to the power cable.

Referring again to FIGS. 4 and 5, flange 420 includes plug diameter/male gland 430 which aids in positioning of the gauge connection and provides a sealing surface. In this embodiment o-rings 431 and 432 are used to provide a seal between the outer diameter of male gland 430 and the inner diameter of an upper flange of the wet-connect electrical connector (342 in FIG. 3).

The bottom end of the pump motor is configured identically with the bottom of the gauge package as shown in FIGS. 4 and 5. The lower end of the pump motor has a set of conductors configured as shown in FIGS. 4 and 5. The gland or ring (see 430) around the male conductors of the pump motor fits within the recess in flange 620. An upper end of wet-connect plug 342 is configured identically with the top of the gauge package as shown in FIGS. 6 and 7, except that there is no separate power conductor similar to conductor 630. The gauge is o-ring sealed at its bottom end (see FIG. 5), while the bottom end of the motor (also configured as in FIG. 5) o-ring seals into the top end of the gauge (which is configured as shown in FIG. 7). After the gauge is installed between the motor and the wet-connect plug, the system is lowered into conduit 370. As the system reaches the end of conduit 370, wet-connect connector 342 plugs into connector 381. This completes the ESP's connection to the surface through power cable 360

The gauge includes conventional wiring 630 that allows sensors and electrical circuitry of the gauge to be connected to sensors and circuitry of the motor. When the ESP system is assembled, wiring 630 is connected to the motor in the same manner as conventional systems. After this wiring is connected, the modular gauge is mated with the motor so that each of the conductors at the top of the gauge is connected to the corresponding conductor at the bottom of the motor, and the gauge is bolted to the motor. Because the lower end of the modular gauge has a connection which is functionally identical to the connection on the lower end of the motor, the system can still make a wet connection to the power cable through the plug at the end of the larger-diameter production tubing/conduit.

In one embodiment, the electrical connections between the conductors of the modular gauge are entirely separate from the functional circuitry of the gauge. In other words, the conductors simply couple the pump motor to the power cable. Any power used by the modular gauge is received from the pump motor rather than directly from the power cable, and any communications to or from the gauge are passed through the motor in the same manner as in conventional systems. In alternative embodiments, however, the modular gauge may be configured to bypass the pump motor, receiving power directly from the power cable, and transmitting or receiving information directly to or from the power cable.

In one embodiment, conventional gauge components are utilized in the modular gauge. These components are positioned off-center in the gauge package. The power leads that connect the male and female conductors of the gauge pass between an inner wall that surrounds the gauge components and the outer wall of the gauge package, thereby bypassing the gauge components.

In one embodiment, the configurations of the upper and lower ends of the modular gauge may make use of o-ring-sealed plug-in connections that are currently used to couple pairs of motors together. Such designs have been tested and have undergone sufficient service to ensure a high level of reliability. The use of a compatible configuration can also allow the modular gauge to be positioned between motor pairs, if desired.

In the primary embodiment described above, three sets of conductors are provided in the modular gauge in order to pass three-phase power through the gauge from the power cable to the pump motor. The conductors are conveniently positioned 120° apart around the axis of the gauge. Alternative embodiments of the invention may use different positioning of the conductors, employ different numbers of conductors, or otherwise vary from the specific configuration described above.

Alternative embodiments may include methods of using modular gauges of the type described above. For example, one method may include the steps of: providing a modular gauge configured to pass electrical signals from a first connector on a first end of the modular gauge to a second connector on the other end of the modular gauge; connecting the modular gauge to the lower end of a pump system; connecting the pump system to the end of first tubing; lowering the first tubing and pump system into second tubing; engaging the connector at the bottom of the modular gauge with a connector secured to the lower end of the second tubing; and providing power through the connector at the lower end of the second tubing, through the modular gauge, to the pump system.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A modular gauge package for use with a wet-connect electric submersible pump (ESP), the modular gauge package comprising:

a body;

a gauge electronics assembly housed within the body;

a first electrical connector on an upper end of the body, wherein the first electrical connector is configured to engage a first complementary electrical connector at the lower end of a pump motor; and a second electrical connector on a lower end of the body, wherein the second electrical connector is configured to engage a second complementary electrical connector that is coupled to a power cable at the lower end of a production conduit;

wherein the first electrical connector is electrically coupled to the second electrical connector such that power supplied to the second electrical connector is passed through the modular gauge package to the first electrical connector; and wherein the modular gauge package includes at least one additional conductor which is electrically connected to the gauge electronics assembly, wherein the at least one additional conductor is configured to be connected to a corresponding power conductor of the ESP.

2. The modular gauge package of claim 1, wherein the first electrical connector is electrically coupled to the second electrical connector by a first set of conductors, wherein each of the conductors in the first set of conductors is enclosed within the body.

3. The modular gauge package of claim 1, wherein the first electrical connector is functionally identical to the second complementary electrical connector and the second electrical connector is functionally identical to the first complementary electrical connector.

4. The system of claim 2, wherein three-phase power is provided to the second electrical connector, and wherein the first set of conductors includes three separate conductors, each of which is configured to carry a different phase of the three-phase power.

5. A method for providing power to an electric submersible pump (ESP) system, the method comprising:

providing power to a first electrical connector at a lower end of a conduit within a well bore;

connecting a gauge package to a lower end of the ESP system, wherein the gauge package has a first set of one or more conductors which extend therethrough, wherein each of the conductors in the first set has an upper end which is electrically connected to a motor section of the ESP system, and wherein each of the conductors in the first set has a lower end which is coupled to a second electrical connector;

lowering the ESP system and gauge package into the conduit; and engaging the second electrical connector on the gauge package with the first electrical connector at the end of the conduit, thereby electrically coupling the power from the first electrical connector to the motor section of the ESP system through the first set of conductors which extend through the gauge package;

wherein the gauge package includes at least one additional conductor which is electrically connected to a gauge electronics assembly housed within the gauge package, and wherein connecting the gauge package to the lower end of the ESP system further comprises connecting the at least one additional conductor to a power conductor at a lower end of the ESP system.

6. The method of claim 5, wherein the motor section of the ESP system comprises a three-phase motor, and wherein the at least one additional conductor is electrically connected to a Y-point of the motor section of the ESP system.

7. The method of claim 5, wherein providing power to the first electrical connector comprises providing three-phase power, and wherein the first set of conductors includes three conductors, wherein each of the three conductors carries a different phase of the three-phase power to the motor section of the ESP system.

8. The method of claim 5, wherein the first electrical connector comprises a wet-connect electrical connector, wherein connecting the gauge package to the lower end of the ESP system comprises connecting a modular gauge package between a lower end of the motor section of the ESP system and the wet-connect electrical connector, wherein the upper end of each of the conductors in the first set is coupled to a first modular connector at an upper end of the gauge package and the lower end of each of the conductors in the first set is coupled to a second modular connector at a lower end of the gauge package, and wherein the first and second modular connectors are complementary to each other.

* * * * *